US008427071B2

(12) United States Patent
Liang et al.

(10) Patent No.: US 8,427,071 B2
(45) Date of Patent: Apr. 23, 2013

(54) LIGHT EMITTING DIODE DRIVING DEVICE WITH A SIMPLE STRUCTURE AND AN ENHANCED EFFICIENCY

(75) Inventors: Tsorng-Juu Liang, Kaohsiung (TW); Wei-Ching Tseng, Kaohsiung (TW); Jiann-Fuh Chen, Tainan County (TW)

(73) Assignee: National Cheng Kung University, Tainan (TW)

( * ) Notice: Subject to any disclaimer, the term of this patent is extended or adjusted under 35 U.S.C. 154(b) by 258 days.

(21) Appl. No.: 12/942,245

(22) Filed: Nov. 9, 2010

(65) Prior Publication Data

US 2011/0156602 A1 Jun. 30, 2011

(30) Foreign Application Priority Data

Dec. 31, 2009 (TW) ..... 98146413 A

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| *H05B 37/00* | (2006.01) |
| *H05B 39/00* | (2006.01) |
| *H05B 41/14* | (2006.01) |
| *H05B 41/16* | (2006.01) |
| *H05B 41/24* | (2006.01) |

(52) U.S. Cl.

USPC ..... 315/291; 315/201; 315/210; 315/246; 315/250; 315/185 R; 315/312

(58) Field of Classification Search ..... None
See application file for complete search history.

(56) References Cited

U.S. PATENT DOCUMENTS

| | | | | |
|---|---|---|---|---|
| 7,745,970 | B2 * | 6/2010 | Radecker et al. | 310/316.01 |
| 2007/0138971 | A1 * | 6/2007 | Chen | 315/209 R |
| 2010/0084984 | A1 * | 4/2010 | Leon Rovira et al. | 315/210 |

* cited by examiner

*Primary Examiner* — Douglas W Owens
*Assistant Examiner* — Dedei K Hammond
(74) *Attorney, Agent, or Firm* — Greenberg Traurig, LLP

(57) ABSTRACT

An LED driving device includes: an LED circuit having an input side for receiving a driving current corresponding to an AC input voltage from an external power source when the magnitude of a driving voltage across the input side is greater than a predetermined value; and a clamp circuit coupled between the input side of the LED circuit and the external power source, and permitting the driving current to pass through for clamping the magnitude of the driving current to a predetermined current level and for clamping the magnitude of the driving voltage to a predetermined voltage level.

17 Claims, 10 Drawing Sheets

LIGHT EMITTING DIODE DRIVING DEVICE WITH A SIMPLE STRUCTURE AND AN ENHANCED EFFICIENCY

CROSS-REFERENCE TO RELATED APPLICATION

This application claims priority of Taiwanese Application No. 098146413, filed on Dec. 31, 2009.

BACKGROUND OF THE INVENTION

1. Field of the Invention

The invention relates to a driving device, and more particularly to a light emitting diode (LED) driving device.

2. Description of the Related Art

AC-LEDs can be directly driven with a commercial AC power source. However, referring to FIG. 1, when a current ($i_{ac}$) flowing through an AC-LED increases due to an increased input voltage ($v_{ac}$), a droop effect occurs, thereby resulting in a reduced lighting efficiency. Furthermore, since the AC-LED is sensitive to variation of the input voltage ($v_{ac}$), a small variance in the input voltage ($v_{ac}$) may cause the AC-LED to blink. In addition, since the AC-LED is designed to endure a peak voltage of the input voltage ($v_{ac}$), it has a larger conduction voltage, thereby resulting in lower power factor.

FIG. 2 illustrates a conventional LED driving device disclosed in U.S. Pat. No. 6,989,807. The conventional LED driving device includes a bridge rectifier 30, a current switching circuit 10, a plurality of LEDs, and a voltage detector 20. The bridge rectifier 30 receives and rectifies an AC voltage from a power supply (not shown), and outputs a rectified voltage. The voltage detector 20 controls the current switching circuit 10 based on the rectified voltage from the bridge rectifier 30 to change the number of the LEDs, which are conducted.

However, the current switching circuit 10 has a relatively complex structure, which increases difficulty in current control. There are too many components used in the conventional LED driving device, thereby resulting in a relatively large volume and higher costs.

SUMMARY OF THE INVENTION

Therefore, an object of the present invention is to provide an LED driving device that can overcome the aforesaid drawbacks of the prior art.

According to one aspect of the present invention, an LED driving device comprises:

an LED circuit having an input side for receiving a driving current corresponding to an AC input voltage from an external power source when the magnitude of a driving voltage across said input side is greater than a predetermined value; and a clamp circuit coupled between said input side of said LED circuit and the external power source, the clamp circuit permitting the driving current to pass through for clamping the magnitude of the driving current to a predetermined current level and for clamping the magnitude of the driving voltage to a predetermined voltage level.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
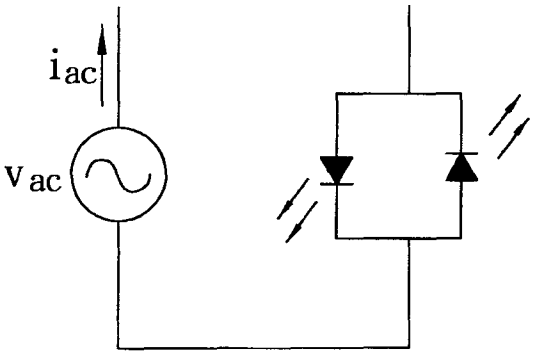
FIG. 1 PRIOR ART
FIG. 1 is a schematic electrical circuit diagram illustrating AC LEDs driven with a commercial AC power source.
Figure 2:
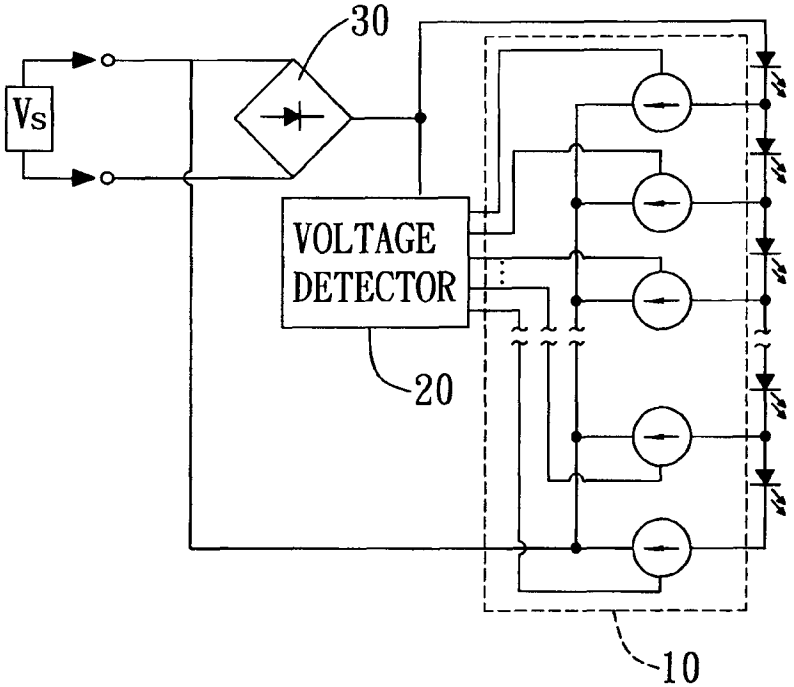
FIG. 2 PRIOR ART
FIG. 2 is a schematic electrical circuit diagram of a conventional LED driving circuit.

Before the present invention is described in greater detail, it should be noted that like elements are denoted by the same reference numerals throughout the disclosure.

Figure 3:
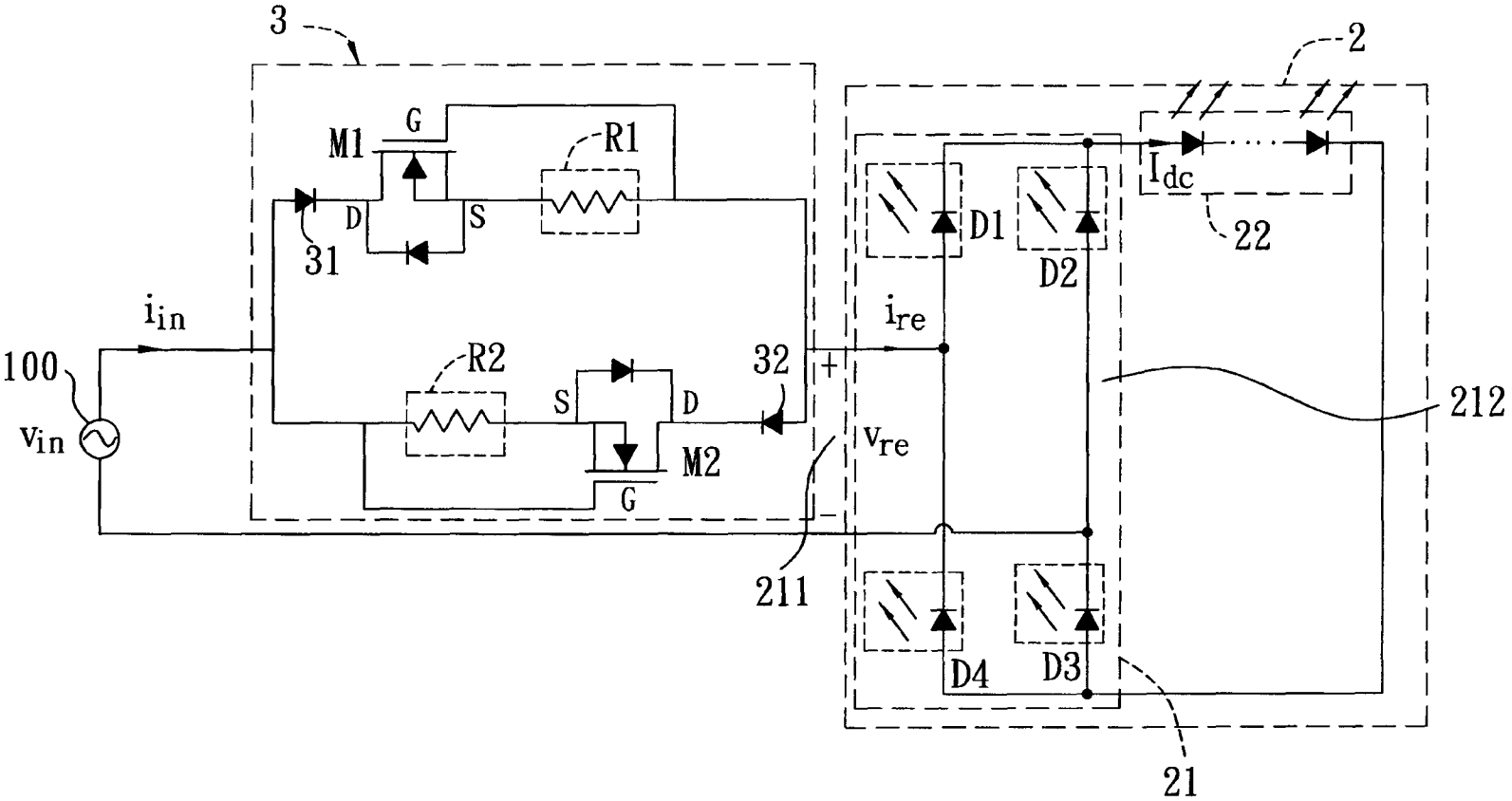
FIG. 3 is a schematic electrical circuit diagram illustrating the first preferred embodiment of an LED driving device according to the present invention.

Referring to FIG. 3, the first preferred embodiment of an LED driving device according to the present invention is shown to include an LED circuit 2, and a clamp circuit 3.

Figure 4:
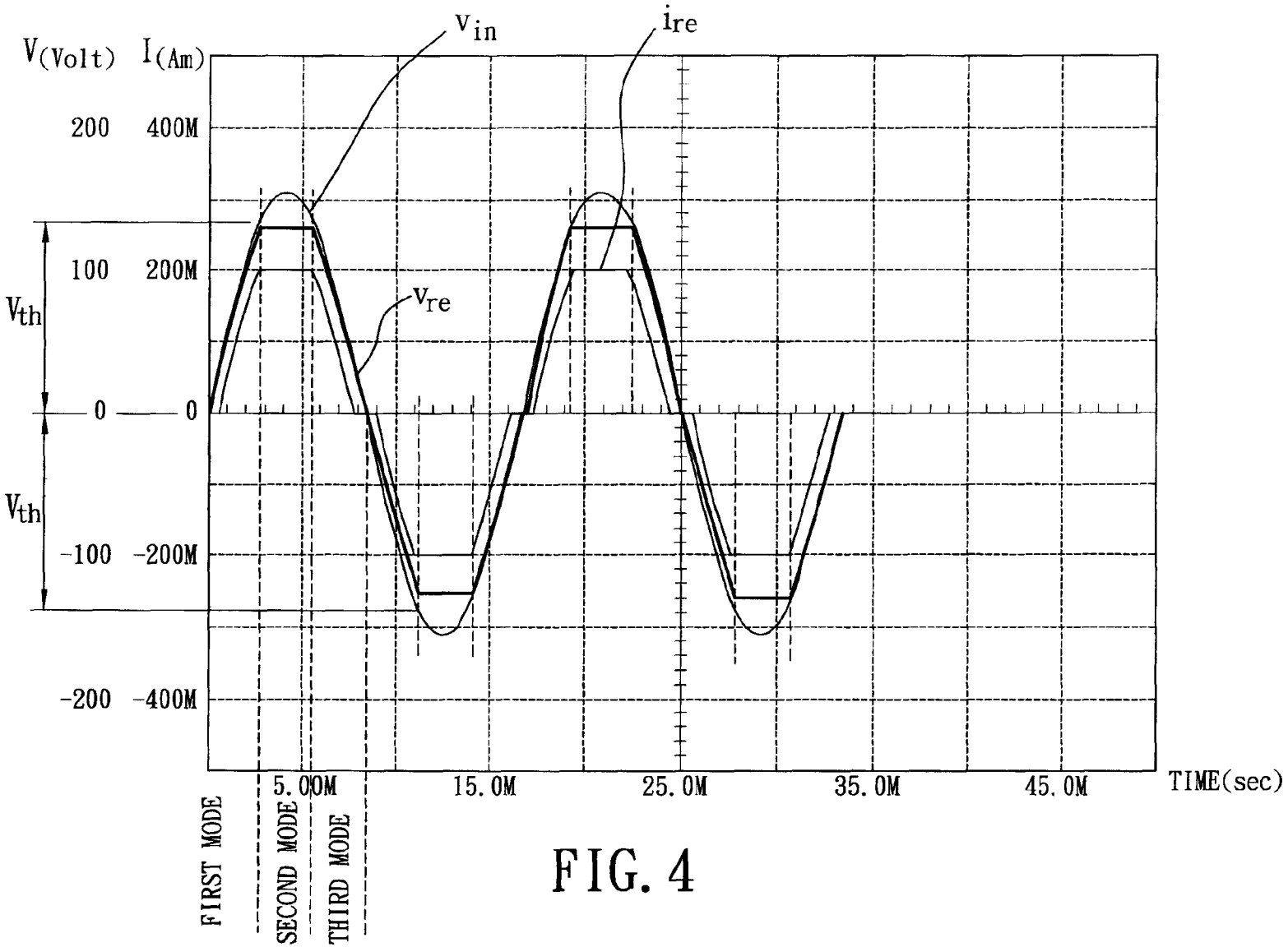
FIG. 4 illustrates waveforms of an AC input voltage ($v_{in}$), a driving current ($i_{re}$) and a driving voltage ($v_{re}$) of the first preferred embodiment.

The LED circuit 2 has an input side 211 adapted to receive a driving current ($i_{re}$) corresponding to an AC input voltage ($v_{in}$) from an external power source 100 when the magnitude of a driving voltage ($v_{re}$) across the input side 21 is greater than a predetermined value. In this embodiment, the input voltage ($v_{in}$) is a sinusoidal signal, as shown in FIG. 4. The LED circuit 2 includes a full-wave bridge rectifier 21 and an LED unit 22. The full-wave bridge rectifier 21 has an input side that serves as the input side 21 of the LED circuit 2, and an output side 212. The full-wave bridge rectifier 21 rectifies the driving voltage ($v_{re}$) to output at the output side 212 a DC current ($I_{dc}$) that corresponds to the rectified driving voltage ($v_{re}$). In this embodiment, the full-wave bridge rectifier 21 consists of four diode units (D1, D2, D3, D4). When the input voltage ($v_{in}$) is at a positive half of the sinusoidal signal while the magnitude of the driving voltage ($v_{re}$) is greater than the predetermined value, the diode units (D1, D3) conduct. When the input voltage ($v_{in}$) is at a negative half of the sinusoidal signal while the magnitude of the driving voltage ($v_{re}$) is greater than the predetermined value, the diode units (D2, D4) conduct. In this embodiment, each of the diode units (D1, D2, D3, D4) includes an LED. In other embodiments, each of the diode units (D1, D2, D3, D4) can include a diode, or a series connection of a diode, an LED and a resistor. The LED unit 22 is coupled across the output side 212 of the rectifier 21 for receiving the DC current ($I_{dc}$) and for permitting the DC current ($I_{dc}$) to pass through. In this embodiment, the LED unit 22 includes a plurality of LEDs connected in series.

The clamp circuit 3 is coupled between the input side 211 of the LED circuit 2 and the external power source 100, and permits the driving current ($i_{re}$) to pass through for clamping the magnitude of the driving current ($i_{re}$) to a predetermined current level and for clamping the magnitude of the driving voltage ($v_{re}$) to a predetermined voltage level. In this embodiment, the clamp circuit 3 includes first and second diodes 31, 32, first and second transistors (M1, M2), and first and second current limiting units. Each of the first and second transistors (M1, M2) is a depletion-mode NMOSFET. Each of the first and second current limiting units (R1, R2) includes a resistor. The first diode 31 has an anode adapted to be coupled to the power source 100, and a cathode. The first transistor (M1) has a first end, such as a drain, coupled to the cathode of the first diode 31, a second end, such as a source, and a control end, such as a gate, coupled to the input side 211 of the LED circuit 2. The first current limiting unit (R1) is coupled between the second end and the control end of the first transistor (M1). The second diode 32 has an anode coupled to the input side 211 of the LED circuit 2, and a cathode. The second transistor (M2) has a first end, such as a drain, coupled to the cathode of the second diode 32, a second end, such as a source, and a control end, such as a gate, adapted to be coupled to the power source 100. The second current limiting unit (R2) is coupled between the second end and the control end of the second transistor (M2).

Referring to FIG. 4, when the input voltage ($v_{in}$) is at the positive half of the sinusoidal signal, the clamp circuit 3 is operable among first, second and third modes based on a gate-source voltage ($V_{GS}$) of the first transistor (M1). In the first mode, when the magnitude of the input voltage ($v_{in}$) gradually increases and is not greater than a predetermined threshold voltage (Vth), the first transistor (M1) is operated in the ohmic area such that a voltage across the first current limiting unit (R1) increases, thereby gradually decreasing the voltage ($V_{GS}$). In this case, the driving current ($i_{re}$) gradually increases with the input voltage ($v_{in}$). In the second mode, because the magnitude of the input voltage ($v_{in}$) is greater than the predetermined threshold voltage (Vth), when the magnitude of the input voltage ($V_{in}$) gradually increases, the driving current ($i_{re}$) flowing through the first current limiting unit (R1) gradually increases such that the voltage ($V_{GS}$) gradually decreases to lower the threshold voltage of the first transistor (M1). In this case, the first transistor (M1) is operated in the saturation area such that the impedance of the first transistor (M1) increases, thereby clamping the magnitude of the driving current ($i_{re}$) to the predetermined current level. In the third mode, because the magnitude of the input voltage ($v_{in}$) decreases and is not greater than the predetermined threshold voltage (Vth), the first transistor (M1) is operated in the ohmic area. In this case, the driving current ($i_{re}$) decreases with the input voltage ($v_{in}$). Because the magnitude of the driving current ($i_{re}$) is clamped to the predetermined current level when the magnitude of the input voltage (vin) is greater than the predetermined threshold voltage (Vth), the magnitude of the driving voltage ($v_{re}$) is thus clamped to the predetermined voltage level. In addition, while the input voltage ($v_{in}$) is at the positive half of the sinusoidal signal, the second transistor (M2) does not conduct.

Given that operation of the clamp circuit 3 while the input voltage ($v_{in}$) is at the negative half of the sinusoidal signal is similar to that while the input voltage ($v_{in}$) is at the positive half of the sinusoidal signal, details of the same are omitted herein for the sake of brevity.

It is noted that, when the first and second transistors (M1, M2) are operated in the ohmic area, the first and second transistors (M1, M2) have a very small equivalent impedance. Thus, the first and second transistors (M1, M2) are regarded as a short circuit. When the first and second transistors (M1, M2) are operated in the saturation area, the first and second transistors are regarded as a variable resistor.

Therefore, the clamp circuit 3 effectively controls the driving current ($i_{re}$) with variation of the input voltage ($v_{in}$), thereby enhancing the lighting efficiency of the LED circuit 2.

Figure 5:
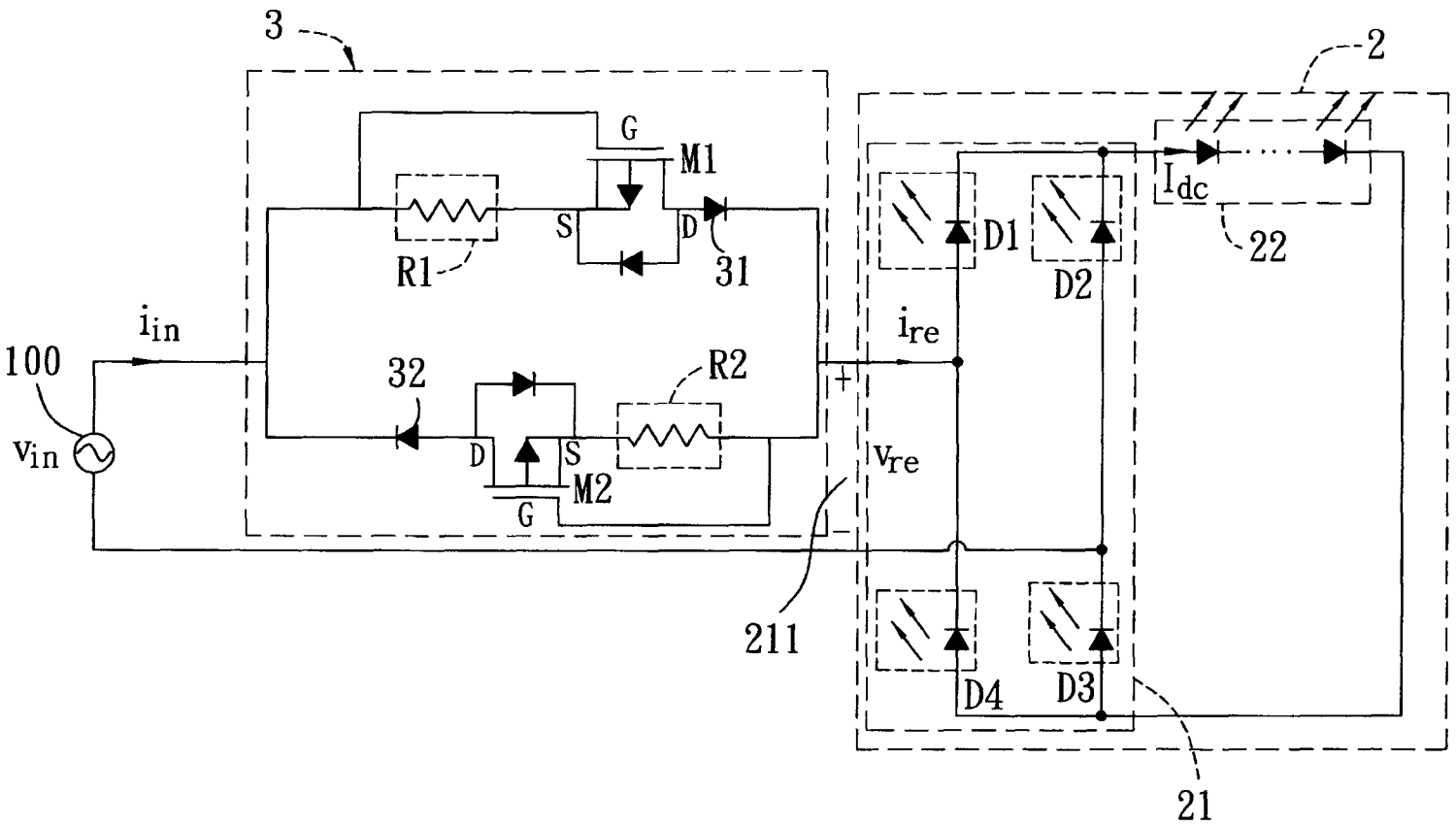
FIG. 5 is a schematic electrical circuit diagram illustrating a variation of the first preferred embodiment.

FIG. 5 illustrates a variation of the first preferred embodiment that differs from the first preferred embodiment in that each of the first and second transistors (M1, M2) is a depletion-mode PMOSFET. In addition, the anode and the cathode of the first diode 31 are coupled respectively to the first end of the first transistor (M1) and the input side 211 of the LED circuit 2. The third end of the first transistor (M1) is adapted to be coupled to the power source 100. The first current limiting unit (R1) is coupled between the second and third ends of the first transistor (M1). The anode and the cathode of the second diode 32 are coupled respectively to the first end of the second transistor (M2) and the power source 100. The third end of the second transistor (M2) is coupled to the input side 211 of the LED circuit 2. The second current limiting unit (R2) is coupled between the second and third ends of the second transistor (M2).

Figure 6:
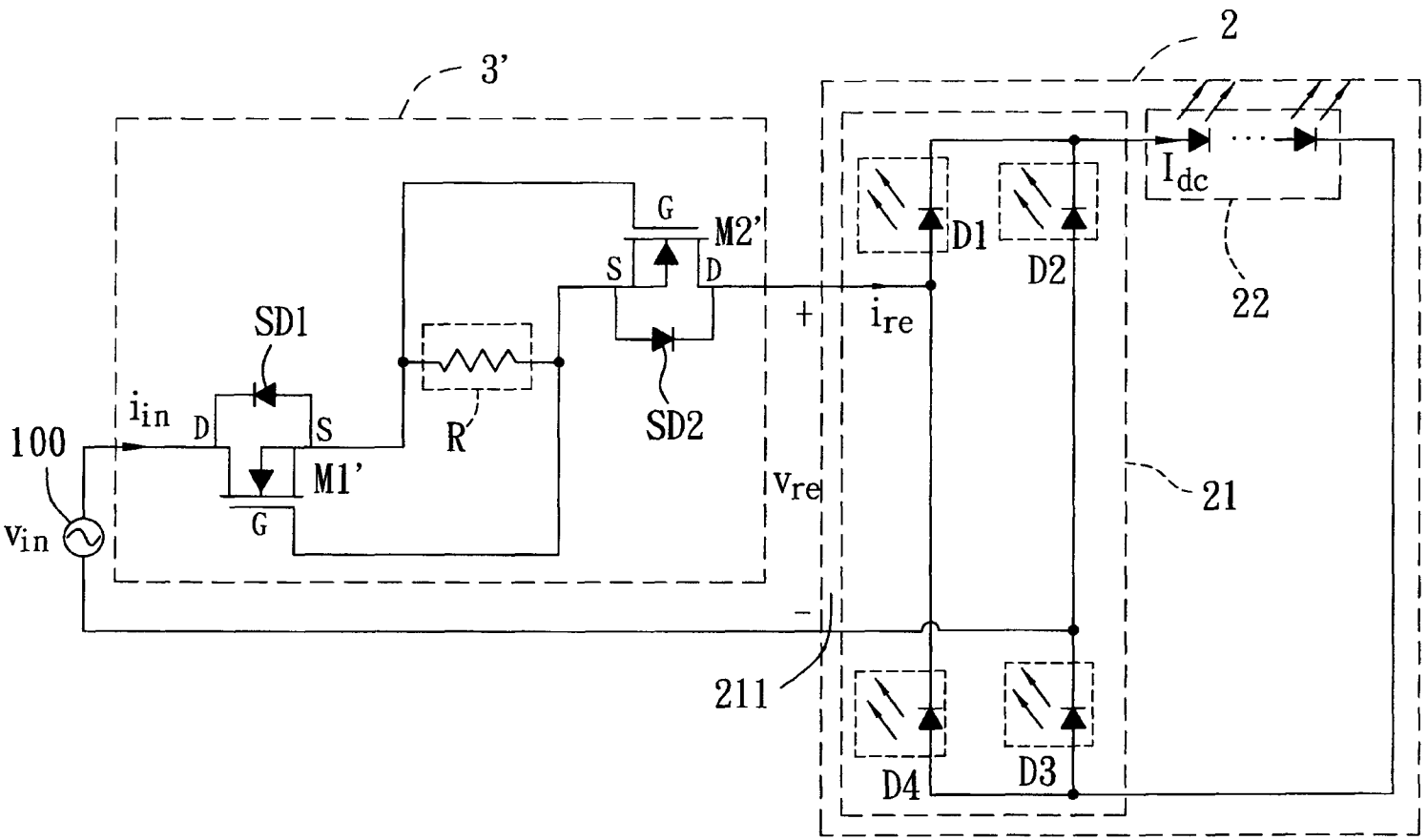
FIG. 6 is a schematic electrical circuit diagram illustrating the second preferred embodiment of an LED driving device according to the present invention.

FIG. 6 illustrates the second preferred embodiment of an LED driving device according to this invention, which is a modification of the first preferred embodiment. Unlike the first preferred embodiment, the clamp circuit 3' includes first and second transistors (M1', M2'), and a current limiting unit (R). The first and second transistors (M1') have constructions similar to those of the first preferred embodiment. In this embodiment, the first and second ends of the first transistor (M1') are coupled respectively to the power source 100, and the control end of the second transistor (M2'). The first end of the second transistor (M2) is coupled to the input side 211 of the LED circuit 2. In addition, the first transistor (M1') further has an intrinsic diode (SD1) that has an anode and a cathode coupled respectively to the second and first ends, i.e., the source and the drain, of the first transistors (M1'). The second transistor (M2') further has an intrinsic diode (SD2) that has an anode and a cathode coupled respectively to the second and first ends, i.e., the source and the drain, of the second transistors (M2'). The current limiting unit (R) is coupled between the control ends of the first and second transistors (M1, M2), and has the same construction as that of each of the first and second current limiting units (R1, R2) of the first preferred embodiment.

Figure 7:
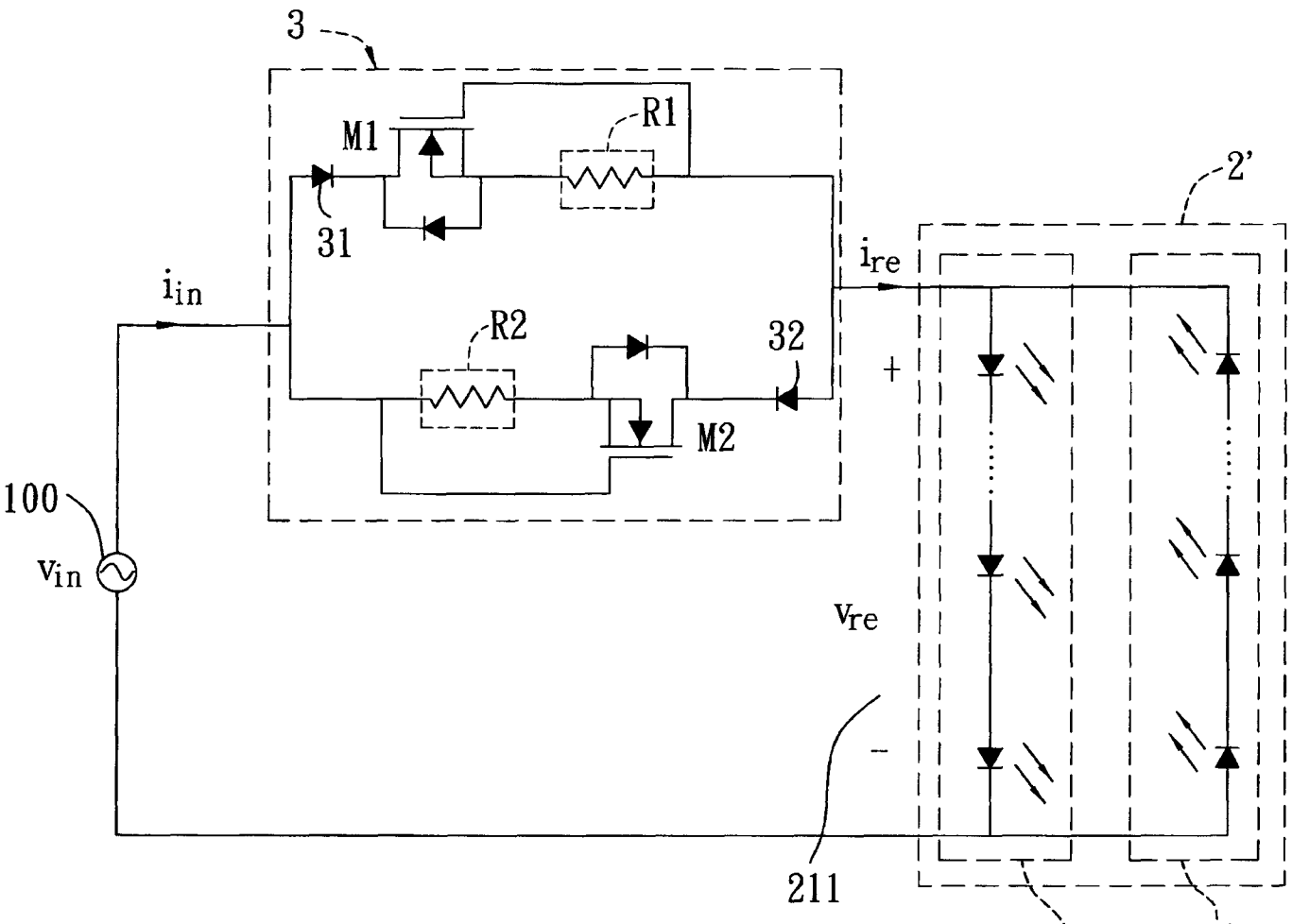
FIG. 7 is a schematic electrical circuit diagram illustrating the third preferred embodiment of an LED driving device according to the present invention.

FIG. 7 illustrates the third preferred embodiment of an LED driving device according to this invention, which is another modification of the first preferred embodiment. Unlike the first preferred embodiment, the LED circuit 2' includes first and second LED units 23, 24 connected in parallel across the input side 211. When the input voltage ($v_{in}$) is positive, the first LED unit 23 conducts and the second LED unit 24 does not conduct. When the input voltage ($v_{in}$) is negative, the first LED unit 23 does not conduct and the second LED unit 24 conducts. In this embodiment, each of the first and second LED units 23, 24 includes a plurality of LEDs connected in series.

Figure 8:
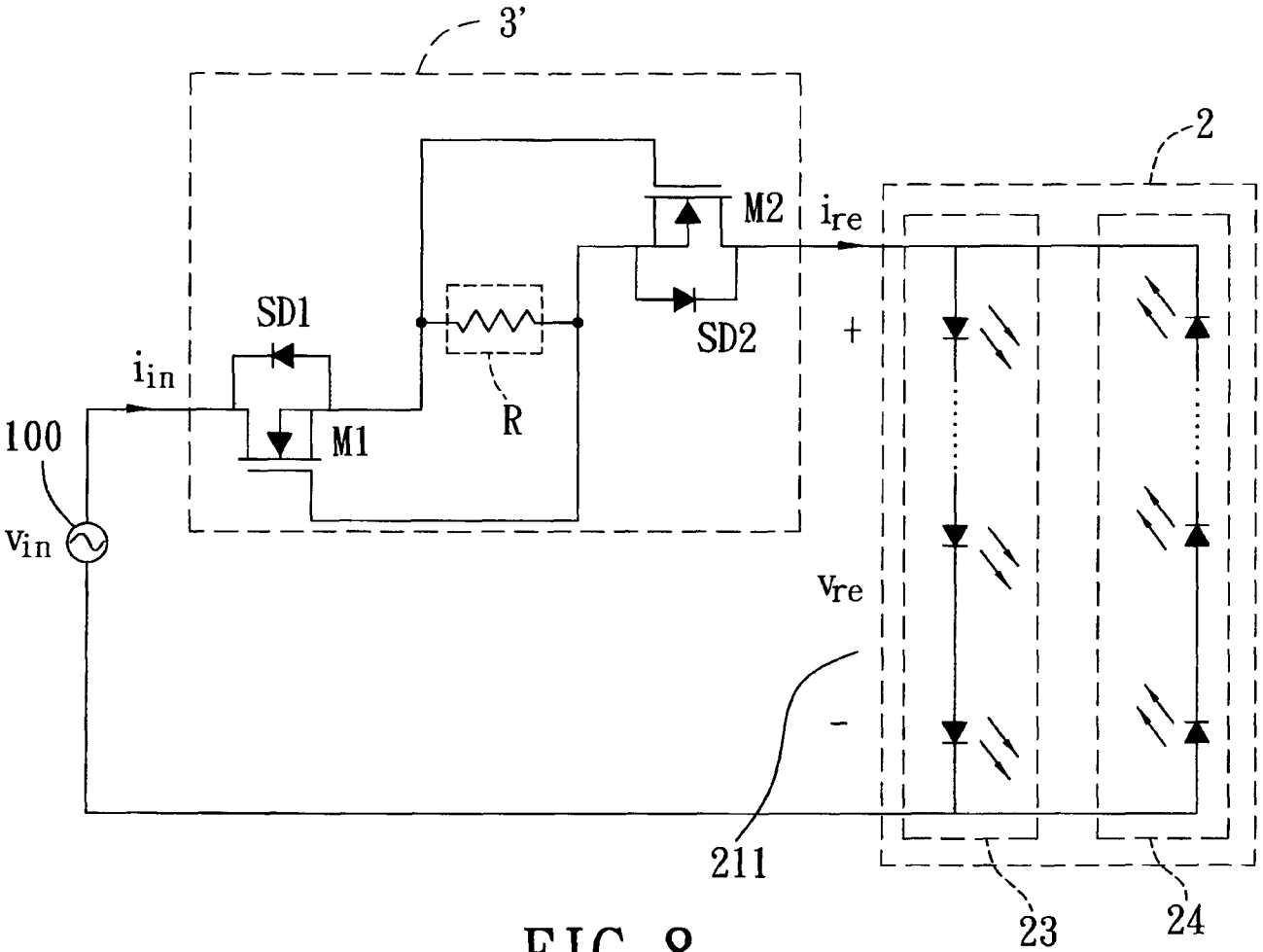
FIG. 8 is a schematic electrical circuit diagram illustrating the fourth preferred embodiment of an LED driving device according to the present invention.

FIG. 8 illustrates the fourth preferred embodiment of an LED driving device according to this invention, which is a modification of the third preferred embodiment. Unlike the third preferred embodiment, the clamp circuit 3' is the same as that of the second preferred embodiment.

Figure 9:
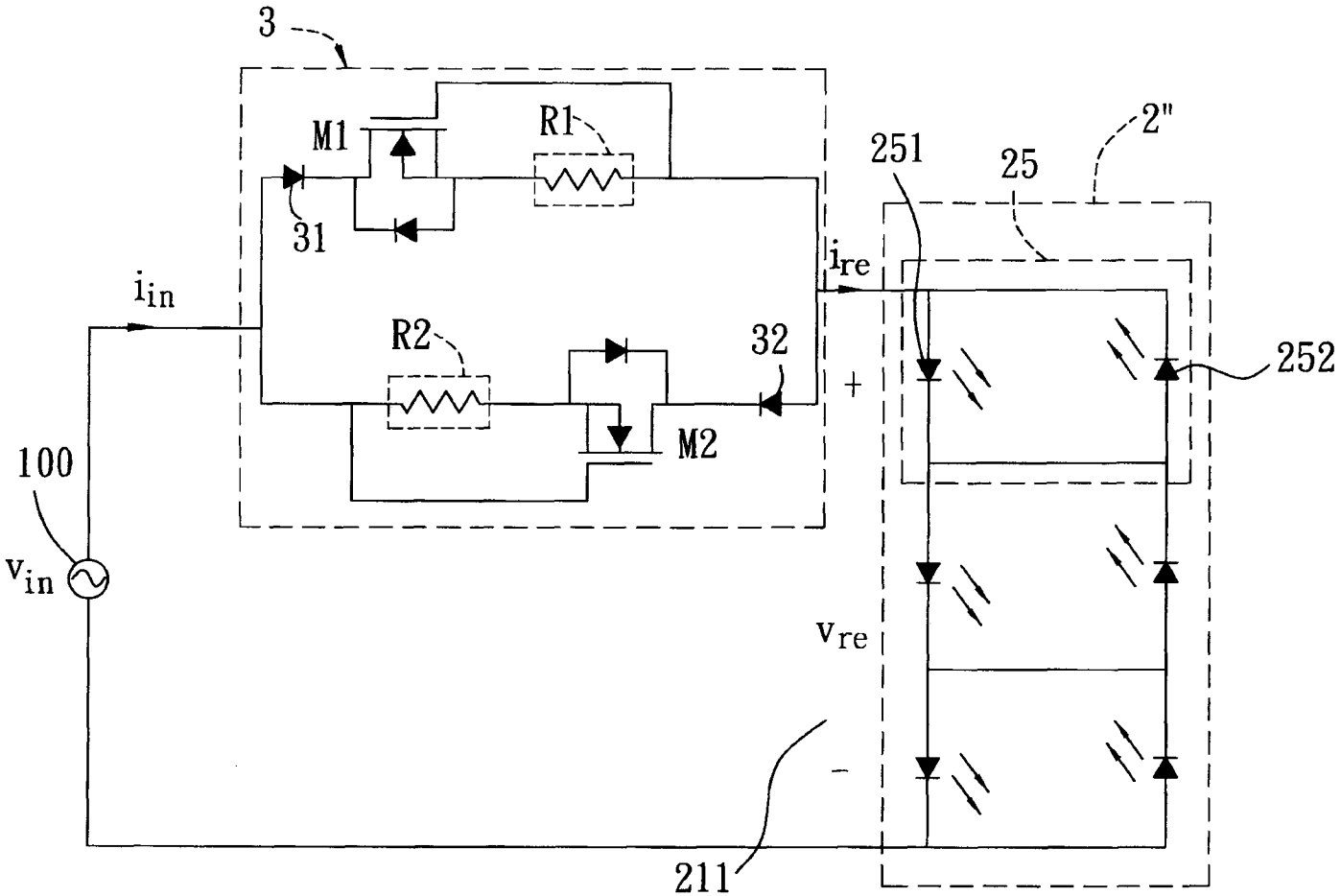
FIG. 9 is a schematic electrical circuit diagram illustrating the fifth preferred embodiment of an LED driving device according to the present invention.

FIG. 9 illustrates the fifth preferred embodiment of an LED driving device according to this invention, which is a modification of the first preferred embodiment. Unlike the first preferred embodiment, the LED circuit 2" includes a plurality of LED units 25 connected in series across the input side 211. Each of the LED units 25 includes first and second LEDs 251, 252, each of which has an anode and a cathode. For each LED unit 25, the anode of one of the first and second LEDs 251, 252 is coupled to the cathode of the other one of the first and second LEDs 251, 252.

Figure 10:
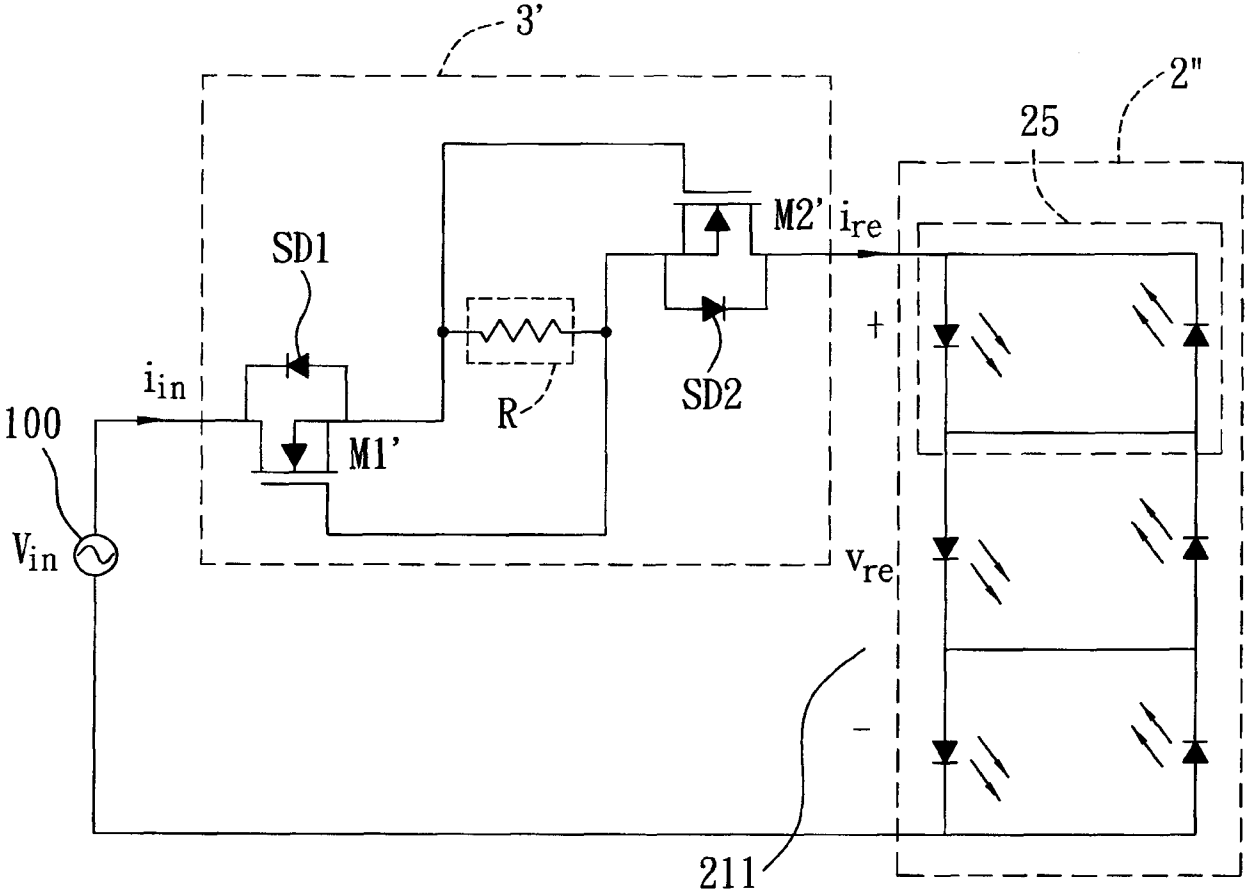
FIG. 10 is a schematic electrical circuit diagram illustrating the sixth preferred embodiment of an LED driving device according to the present invention.

FIG. 10 illustrates the sixth preferred embodiment of an LED driving device according to this invention, which is a modification of the fifth preferred embodiment. Unlike the fifth preferred embodiment, the clamp circuit 3' is the same as that of the second preferred embodiment.

The following are some of the advantages attributed to the LED driving device of the present invention:

1. The LED driving device of the present invention has a relatively simple structure, thereby reducing fabrication costs.

2. Because the clamp circuit 3, 3' can effectively clamp the driving current ($i_{re}$) to the predetermined current level, the droop effect of the LED circuit 2, 2' can be avoided, thereby resulting in an enhanced lighting efficiency.

3. The number of the LEDs in the LED circuit 2, 2', 2" can be determined based on a required power factor to conform to a desired specification.

4. The clamp circuit 3, 3' can clamp the driving current ($i_{re}$) to the predetermined current level, and can stabilize light output of each LED.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A light emitting diode (LED) driving device comprising:

an LED circuit having an input side for receiving a driving current corresponding to an AC input voltage from an external power source when the magnitude of a driving voltage across said input side is greater than a predetermined value; and a clamp circuit coupled between said input side of said LED circuit and the external power source, said clamp circuit permitting the driving current to pass through for clamping the magnitude of the driving current to a predetermined current level and for clamping the magnitude of the driving voltage to a predetermined voltage level wherein said clamp circuit includes:

a first diode having an anode adapted to be coupled to the power source, and a cathode;

a first transistor having a first end coupled to said cathode of said first diode, a second end, and a control end coupled to said input side of said LED circuit;

a first current limiting unit coupled between said second end and said control end of said first transistor;

a second diode having an anode coupled to said input side of said LED circuit, and a cathode;

a second transistor having a first end coupled to said cathode of said second diode, a second end, and a control end adapted to be coupled to the power source; and a second current limiting unit coupled between said second end and said control end of said second transistor.

2. The LED driving device as claimed in claim 1, wherein said LED circuit includes:

a rectifier having an input side serving as said input side of said LED circuit, and an output side, said rectifier rectifying the driving voltage to output at said output side a DC current that corresponds to the driving voltage rectified thereby; and an LED unit coupled across said output side of said rectifier for receiving the DC current therefrom, and permitting the DC current to pass through.

3. The LED driving device as claimed in claim 2, wherein said rectifier is a full-wave bridge rectifier that consists of four diode units.

4. The LED driving device as claimed in claim 3, wherein each of said diode units includes one of an LED and a diode.

5. The LED driving device as claimed in claim 2, wherein said LED unit of said LED circuit includes a plurality of LEDs connected in series.

6. The LED driving device as claimed in claim 1, wherein each of said first and second transistors is a depletion-mode NMOSFET.

7. The LED driving device as claimed in claim 1, wherein each of said first and second current limiting units includes a resistor.

8. A light emitting diode (LED) driving device comprising:

an LED circuit having an input side for receiving a driving current corresponding to an AC input voltage from an external power source when the magnitude of a driving voltage across said input side is greater than a predetermined value; and a clamp circuit coupled between said input side of said LED circuit and the external power source, said clamp circuit permitting the driving current to pass through for clamping the magnitude of the driving current to a predetermined current level and for clamping the magnitude of the driving voltage to a predetermined voltage level;

wherein said clamp circuit includes:

a first diode having an anode, and a cathode coupled to said input side of said LED circuit;

a first transistor having a first end coupled to said anode of said first diode, a second end, and a control end adapted to be coupled to the power source;

a first current limiting unit coupled between said second end and said control end of said first transistor;

a second diode having an anode, and a cathode adapted to be coupled to the power source;

a second transistor having a first end coupled to said anode of said second diode, a second end, and a control end coupled to said input side of said LED circuit; and a second current limiting unit coupled between said second end and said control end of said second transistor.

9. The LED driving device as claimed in claim 8, wherein each of said first and second transistors is a depletion-mode PMOSFET.

10. The LED driving device as claimed in claim 8, wherein each of said first and second current limiting units includes a resistor.

11. A light emitting diode (LED) driving device comprising:

an LED circuit having an input side for receiving a driving current corresponding to an AC input voltage from an external power source when the magnitude of a driving voltage across said input side is greater than a predetermined value; and a clamp circuit coupled between said input side of said LED circuit and the external power source, said clamp circuit permitting the driving current to pass through for clamping the magnitude of the driving current to a predetermined current level and for clamping the magnitude of the driving voltage to a predetermined voltage level;

wherein said clamp circuit includes:

a first transistor having a first end adapted to be coupled to the power source, a second end, and a control end;

a second transistor having a first end coupled to said input side of said LED circuit, a second end coupled to said control end of said first transistor, and a control end coupled to said second end of said first transistor; and a current limiting unit coupled between said control end of said first transistor and said control end of said second transistor.

12. The LED driving device as claimed in claim 11, wherein each of said first and second transistors is a depletion-mode NMOSFET.

13. The LED driving device as claimed in claim 11, wherein:

said first transistor has an intrinsic diode that has an anode and a cathode coupled respectively to said second and first ends of said first transistor; and said second transistor has an intrinsic diode that has an anode and a cathode coupled respectively to said second and first ends of said second transistor.

14. The LED driving device as claimed in claim 11, wherein said current limiting unit includes a resistor.

15. The LED driving device as claimed in claim 1, wherein said LED circuit includes first and second LED units coupled in parallel across said input side, said first LED unit conducting when the AC input voltage is positive, said second LED unit conducting when the AC input voltage is negative.

16. The LED driving device as claimed in claim 15, wherein each of said first and second LED units includes a plurality of LEDs connected in series.

17. The LED driving device as claimed in claim 1, wherein said LED circuit includes a plurality of LED units connected in series across said input side, each of said LED units including first and second LEDs, each of which has an anode and a cathode, said anode of one of said first and second LEDs of each of said LED units being coupled to said cathode of the other one of said first and second LEDs of a corresponding one of said LED units.

* * * * *